US009045380B1

(12) United States Patent
Ganta et al.

(10) Patent No.: US 9,045,380 B1
(45) Date of Patent: Jun. 2, 2015

(54) GAS GENERATING COMPOSITIONS

(75) Inventors: Sudhakar R. Ganta, Troy, MI (US); Graylon K. Williams, Warren, MI (US)

(73) Assignee: TK Holdings Inc., Armada, MI (US)

( * ) Notice: Subject to any disclaimer, the term of this patent is extended or adjusted under 35 U.S.C. 154(b) by 1180 days.

(21) Appl. No.: 12/290,820

(22) Filed: Oct. 31, 2008

Related U.S. Application Data

(60) Provisional application No. 61/001,350, filed on Oct. 31, 2007.

(51) Int. Cl.

| | |
|---|---|
| ***C06B 31/28*** | (2006.01) |
| ***C06B 31/02*** | (2006.01) |
| ***C06B 29/00*** | (2006.01) |
| ***C06B 25/34*** | (2006.01) |

(52) U.S. Cl.
CPC ..... *C06B 31/28* (2013.01); *C06B 31/02* (2013.01)

(58) Field of Classification Search
CPC ..... C06B 31/28; C06B 31/02; C06B 29/00; C06B 25/34
USPC ..... 149/46, 61, 75, 92
See application file for complete search history.

(56) References Cited

U.S. PATENT DOCUMENTS

| | | | | |
|---|---|---|---|---|
| 3,408,307 | A * | 10/1968 | Troscinski et al. | 252/394 |
| 3,719,604 | A | 3/1973 | Prior et al. | 252/186 |
| 3,909,322 | A | 9/1975 | Chang et al. | 149/19.4 |
| 4,111,728 | A | 9/1978 | Ramnarace | 149/19.5 |
| 4,300,962 | A | 11/1981 | Stinecipher et al. | 149/47 |
| 4,909,549 | A | 3/1990 | Poole et al. | 280/738 |
| 4,925,503 | A | 5/1990 | Canterberry et al. | 149/19.4 |
| 4,931,112 | A | 6/1990 | Wardle et al. | 149/88 |
| 4,948,439 | A | 8/1990 | Poole et al. | 149/46 |
| 5,074,938 | A | 12/1991 | Chi | 149/21 |
| 5,139,588 | A | 8/1992 | Poole | 149/61 |
| 5,197,758 | A | 3/1993 | Lund et al. | 280/741 |
| 5,198,046 | A | 3/1993 | Bucerius et al. | 149/61 |
| 5,256,792 | A | 10/1993 | Lee et al. | 548/236.8 |
| 5,439,251 | A | 8/1995 | Onishi et al. | 280/741 |
| 5,501,823 | A | 3/1996 | Lund et al. | 264/3.1 |
| 5,516,377 | A | 5/1996 | Highsmith et al. | 149/18 |
| 5,531,941 | A | 7/1996 | Poole | 264/3.4 |
| 5,545,272 | A | 8/1996 | Poole et al. | 149/48 |
| 5,641,938 | A | 6/1997 | Holland et al. | 149/48 |
| 5,723,812 | A | 3/1998 | Berteleau et al. | 149/46 |
| 5,783,773 | A | 7/1998 | Poole | 149/109.2 |
| 5,872,329 | A | 2/1999 | Burns et al. | 149/36 |
| 5,962,808 | A | 10/1999 | Lundstrom | 149/19.1 |
| 6,017,404 | A | 1/2000 | Lundstrom et al. | 149/36 |
| 6,019,861 | A | 2/2000 | Canterberry et al. | 149/19.1 |
| 6,045,638 | A | 4/2000 | Lundstrom | 149/36 |
| 6,074,502 | A | 6/2000 | Burns et al. | 149/36 |
| 6,123,790 | A | 9/2000 | Lundstrom et al. | 149/47 |
| 6,149,746 | A | 11/2000 | Blomquist | 149/47 |
| 6,210,505 | B1 | 4/2001 | Khandhadia et al. | 149/36 |

(Continued)

*Primary Examiner* — Aileen B Felton
(74) *Attorney, Agent, or Firm* — L.C. Begin & Associates, PLLC.

(57) ABSTRACT

A novel composition containing a bi-tetrazole having a primary tetrazole ring substituted or connected to a second tetrazole ring by an aliphatic bridge such as an ethyl or ethylene bridge. The composition may be contained within a gas generator as a gas generating composition when combined with an oxidizer such as phase stabilized ammonium nitrate. The gas generator may be contained within a gas generating system such as an airbag inflator or seat belt assembly, or more broadly within a vehicle occupant protection system.

10 Claims, 1 Drawing Sheet

(56) References Cited

U.S. PATENT DOCUMENTS

| | | | | |
|---|---|---|---|---|
| 6,306,232 | B1 | 10/2001 | Khandhadia et al. | 149/22 |
| 6,682,616 | B1 | 1/2004 | Yamato et al. | 149/45 |
| 7,393,395 | B2 * | 7/2008 | Aiba et al. | 106/14.16 |
| 7,557,220 | B1 * | 7/2009 | Irvin et al. | 548/254 |
| 2004/0159381 | A1 * | 8/2004 | Kubo et al. | 149/46 |
| 2006/0102258 | A1 * | 5/2006 | Taylor et al. | 149/45 |

* cited by examiner

GAS GENERATING COMPOSITIONS

CROSS-REFERENCE TO RELATED APPLICATIONS

This application claims the benefit of U.S. Provisional Application Ser. No. 61/001,350 filed on Oct. 31, 2007.

TECHNICAL FIELD

The present invention relates generally to gas generating systems, and to gas generating compositions employed in gas generator devices for automotive restraint systems, for example.

BACKGROUND OF THE INVENTION

The present invention relates to gas generant compositions that upon combustion produce a relatively smaller amount of solids and a relatively abundant amount of gas. It is an ongoing challenge to reduce the amount of solids and increase the amount of gas thereby decreasing the filtration requirements for an inflator. As a result, the filter may be either reduced in size or eliminated altogether thereby reducing the weight and/or size of the inflator. Additionally, reduction of combustion solids provides relatively greater amounts of gaseous products per gram or unit of gas generating composition. Accordingly, less gas generant is required when greater mols of gas are produced per gram of gas generant. The result is typically a smaller and less expensive inflator due to reduced manufacturing complexity.

Yet another concern is that the compositions must exhibit burn rates that are satisfactory with regard to use in vehicle occupant protection systems. In particular, compositions containing phase stabilized ammonium nitrate may exhibit relatively lower burn rates requiring various measures to improve the burn rate. Accordingly, the development of energetic fuels is one ongoing research emphasis whereby the less aggressive burn characteristics of preferred oxidizers such as phase stabilized ammonium nitrate are accommodated.

U.S. Pat. No. 5,439,251 to Onishi et al. describes 5,5'-bi-1H-tetrazole (BHT), a bi-tetrazole, as potentially decomposing during powdering, or exploding at the time of loading. Onishi explains that this is due to the high impact and friction sensitivities of BHT. The present inventors also note that bi-tetrazoles such as BHT, bis-tetrazole amine (BTA), and 5,5'-azobis-1H-tetrazole (ABHT) are believed to be corrosive with regard to the various constituents of known airbag gas generators for example. Onishi solves the problem of sensitivity by forming amine salts of bi-tetrazoles that are not so disadvantaged.

U.S. Pat. No. 5,872,329 describes amine salts of bi-tetrazoles including salts of BHT and ABHT. Again, these salts are recognized for their usefulness as fuels in gas generating compositions for gas generators, particularly due to their relative insensitivity as compared to the acidic bi-tetrazoles mentioned above, for example.

U.S. Pat. No. 6,210,505 again describes gas generating compositions containing the amine salts of bi-tetrazoles of U.S. Pat. No. 5,872,329 and phase stabilized ammonium nitrate (PSAN). However, '505 recognizes that the amine salts of bi-tetrazoles when combined with PSAN have reduced energy as compared to the base bi-tetrazoles BHT and ABHT, for example. The resulting less-than-optimum burn rates of these compositions requires the use of a much more robust inflator, with the attendant increased manufacturing costs. To address this concern, metallic oxidizers, and other metal-containing constituents such as clay, are added to improve the burn rates of compositions containing the amine salts of tetrazoles and PSAN, or, to increase the combustion energy of the associated compositions when deployed as gas generating compositions in an airbag gas generator, for example. The addition of metallic oxidizers and other metal-containing constituents, however, produces increased solids and requires increased filtration of the effluent. This typically increases the weight of the associated gas generator.

It would therefore be an improvement in the art to be able to utilize bi-tetrazoles because of advantageous gas production, while yet avoiding the concerns described above.

SUMMARY OF THE INVENTION

The above-referenced concerns are resolved by gas generators or gas generating systems containing at least one bi-tetrazole wherein a primary tetrazole ring is connected to a second tetrazole ring by an alkyl bridge, as a novel fuel. Exemplary alkyl-bridged bi-tetrazoles include more preferably alkyl or aliphatic bridged bi-tetrazoles containing from two to five carbons in the bridge. Bi-tetrazole ethane and ethylene bi-tetrazole are illustrative species. Gas generating compositions of the present invention include bi-tetrazoles substituted or connected by an alkyl bridge containing at least one carbon, and more preferably containing from two to five carbons, for example.

Stated another way, a gas generating system such as a vehicle occupant protection system is provided that contains a fuel selected from a bi-tetrazole, wherein the fuel is a primary tetrazole ring substituted with a second tetrazole ring by an alkyl bridge. In a series of embodiments, the fuel is a bi-tetrazole having an alkyl bridge having one to five carbons, and more preferably two to five carbons.

DETAILED DESCRIPTION OF THE PRESENT INVENTION

Figure 1:
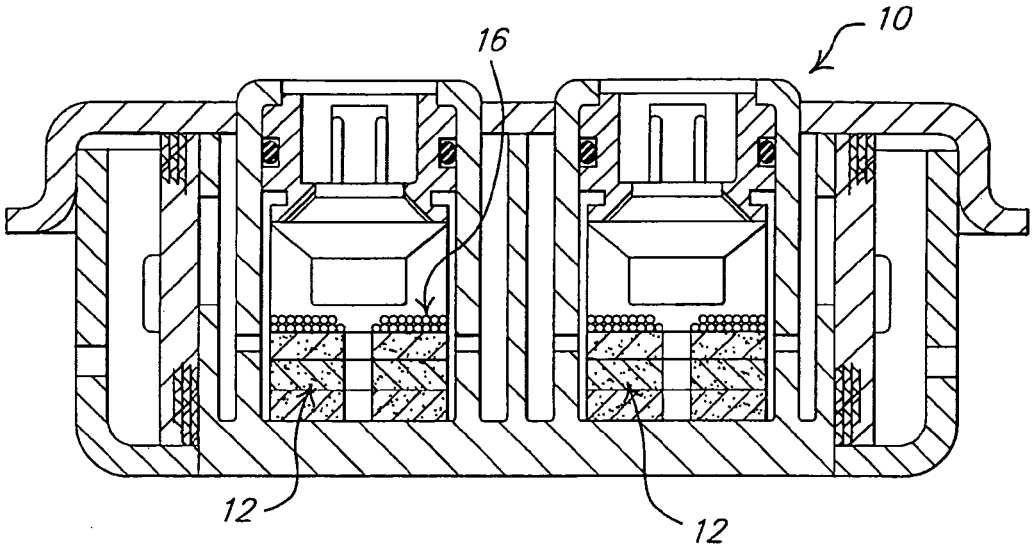
FIG. 1 is a cross-sectional side view showing the general structure of an inflator in accordance with the present invention.

Gas generators or gas generating systems are provided that contain at least one bi-tetrazole substituted via an aliphatic bridge (alkenyl, alkynl, and alkyl, and derivatives thereof) containing at least one carbon, as a novel fuel. Exemplary alkyl-bridged bi-tetrazoles include more preferably aliphatic bridged bi-tetrazoles containing from two to five carbons in the bridge. Bi-tetrazole methane, methylene bi-tetrazole, bi-tetrazole ethane, and ethylene bi-tetrazole are illustrative species of fuels in accordance with the present invention.

Gas generating compositions of the present invention include a primary fuel selected from bi-tetrazoles substituted or connected by an alkyl bridge containing at least two carbons, and more preferably containing from two to five carbons. Bi-tetrazole ethane and ethylene bi-tetrazole are illustrative fuel species. These fuels may be provided by Hygro Chemicals (of Hyderabad, India).

In accordance with the present invention, and as shown in the examples provided below, it has been found that phase stabilized ammonium nitrate (PSAN) is thermally stable with ethylene bridged bi-tetrazole. Furthermore, ethylene bi-tetrazole when combined with PSAN in a gas generant composition burned well under relatively low chamber pressure with low solid gas emissions, and minimal toxicity in the gas effluent.

Optional secondary fuels include tetrazoles such as 5-aminotetrazole; metal salts of azoles such as potassium 5-aminotetrazole; nonmetal salts of azoles such as di-ammonium salt of 5,5'-bis-1H-tetrazole: nitrate salts of azoles such as 5-aminotetrazole; nitramine derivatives of azoles such as 5-aminotetrazole; metal salts of nitramine derivatives of azoles such as dipotassium 5-aminotetrazole; metal salts of nitramine derivatives of azoles such as dipotassium 5-aminotetrazole; nonmetal salts of nitramine derivatives of azoles such as monoammonium 5-aminotetrazole and; guanidiness such as dicyandiamide; salts of guanidines such as guanidine nitrate; nitro derivatives of guanidines such as nitroguanidine; azoamides such as azodicarbonamide; nitrate salts of azoamides such as azodicarbonamidine dinitrate; and mixtures thereof. The secondary fuel can be used within this system as co-fuels to the primary fuel. If used, the secondary fuel when combined with the primary fuel constitutes about 5-45 wt % of the gas generant composition.

An oxidizer component is selected from at least one exemplary oxidizer selected from basic metal nitrates, and, metal and nonmetal nitrates, chlorates, perchlorates, nitrites, oxides, and peroxides such as basic copper (II) nitrate, strontium nitrate, potassium nitrate, potassium nitrite, iron oxide, and copper oxide. Other oxidizers as recognized by one of ordinary skill in the art may also be employed. The oxidizer is generally provided at about 55-95 wt % of the gas generant composition. Phase stabilized ammonium nitrate (stabilized with about 10-15 wt % of potassium nitrate) is a preferred oxidizer. Other phase stabilized ammonium nitrate containing other known stabilizing agents, combined with ammonium nitrate to form phase stabilized ammonium nitrate, are also contemplated.

Processing aids such as fumed silica, boron nitride, and graphite may also be employed. Accordingly, the gas generant may be safely compressed into tablets, or slugged and then granulated. The processing aid is generally provided at about 0-15 wt %, and more preferably at about 0-5 wt %.

Slag formers may also be provided and are selected from silicon compounds such as elemental silicone; silicon dioxide; silicones such as polydimethylsiloxane; silicates such as potassium silicates; natural minerals such as talc and clay, and other known slag formers. The slag former is typically provided at about 0-10 wt %, and more preferably at about 0-5 wt %.

The compositions of the present invention are formed from constituents as provided by known suppliers such as Hygro Chemicals (of Hyderabad, India), Aldrich or Fisher Chemical. The compositions may be provided in granulated form and dry-mixed and compacted in a known manner, or otherwise mixed as known in the art. The compositions may be employed, for example, in gas generators typically found in airbag devices or occupant protection systems, or in safety belt devices, or in gas generating systems such as a vehicle occupant protection system, all manufactured as known in the art, or as appreciated by one of ordinary skill.

The following examples illustrate but do not limit the present invention.

Example 1

Synthesis of Ethylene Bi-Tetrazole (EBT)

Fumaronitrile (at about 25 grams or about 320.225 mmol), sodium azide (at about 58.29 grams or about 896.631 mmol), zinc bromide (at about 92.23 grams or about 350.31 mmol), and about 500 mL of water were added to a one-liter reaction vessel, and mixed. The mixture was heated by oil bath at about 120-123 C, refluxing the mixture for about 36 hours. Afterwards, the reaction was brought to room temperature. About 500 mL of 3N hydrochloric acid was then added to the reaction vessel, and mixed by stirring for about two hours at room temperature.

The resultant yellowish solid was filtered and washed with water (3×200 mL) to yield crude ethylene bi-tetrazole. Further recrystallization from boiling water yielded pure ethylene bi-tetrazole (EBT) at about 72% (i.e. 38 grams). The ethylene aliphatic bridge can be seen in the EBT product shown below.

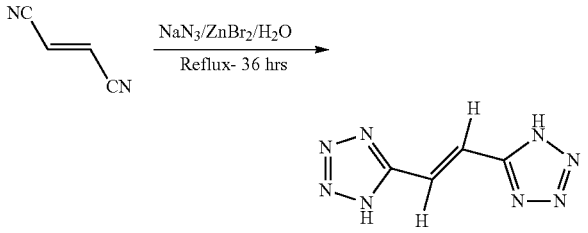

Example 2

Synthesis of Bi-Tetrazole Ethane (BTE)

Succinonitrile (at about 25 grams, or about 3120.1488 mmol), sodium azide (at about 48.7 grams, or about 749.157 mmol), zinc bromide (at about 97.844 grams, or about 374.570 mmol), and about 400 mL of water were added to a one-liter reaction vessel, and mixed. The mixture was heated by oil bath at about 120-123 C, refluxing the mixture for about 36 hours. Afterwards, the mixture was brought to room temperature. About 500 mL of 3N hydrochloric acid was then added to the reaction vessel, and mixed by stirring for about two hours at room temperature. The complex initially dissolved in 3N hydrochloric acid solution and then formed white solid particles.

The resultant white solid was filtered and washed with water (2×100 mL) to yield crude BTE. Further recystallization from boiling water yielded BTE at about 67.9% (about 35 grams). BTE exhibited an oxygen balance of about −105.93. A composition, containing about 17.50 wt. % BTE and about 82.50 wt. % PSAN, exhibited an oxygen balance of about −0.43. The ethyl alkyl bridge can be seen in the product BTE shown below.

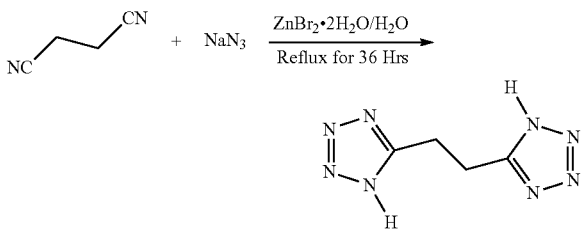

Example 3

Comparative Burn Rates of BHT

A composition was prepared containing BHT and PSAN in accordance with the present invention. Burn rates were determined as per industry standardized tests. At about 600 psig, this composition had a burn rate of about 0.53 inches per second; at about 2500 psig, about 1.4 inches per second; and at about 5500 psig, about 1.95 inches per second. Although the burn rates are very favorable indicating an energetic quality of this fuel, the sensitivity of BHT remains as a concern.

Example 4

Comparative Burn Rates of BTA

A composition was prepared containing bis-tetrazole amine (BTA) and PSAN in accordance with the present invention. Burn rates were determined as per industry standardized tests. At about 1000 psig, this composition had a burn rate of about 0.55 inches per second; at about 2500 psig, about 1.02 inches per second; and at about 5100 psig, about 1.2 inches per second. Although the burn rates are relatively favorable indicating an energetic character of this fuel, the sensitivity of BTA remains as a concern.

Example 5

Comparative Burn Rates of BTA-NH3

A composition was prepared containing monoammonium salt of bis-tetrazole amine (BTA) and PSAN in accordance with the present invention. Burn rates were determined as per industry standardized tests. At about 500 psig, this composition had a burn rate of about 0.25 inches per second; at about 2500 psig, about 0.85 inches per second; and at about 5000 psig, about 1.075 inches per second. The burn rates are relatively lower due to a relatively lower energetic quality of this amine salt of tetrazole, thereby requiring the addition of burn rate modifiers such as metallic oxidizers.

Example 6

Comparative Burn Rates of BHT-2NH3

A composition was prepared containing di-ammonium salt of BHT and PSAN in accordance with the present invention. Burn rates were determined as per industry standardized tests. At about 500 psig, this composition had a burn rate of about 0.18 inches per second; at about 2500 psig, about 0.6 inches per second; and at about 5000 psig, about 1.05 inches per second. The burn rates are relatively lower due to a relatively lower energetic character of this amine salt of tetrazole, thereby requiring the addition of burn rate modifiers such as metallic oxidizers.

Example 7

Comparative Burn Rates of EBT

A composition was prepared containing EBT and PSAN in accordance with the present invention. Burn rates were determined as per industry standardized tests. At about 500 psig, this composition had a burn rate of about 0.4 inches per second; at about 2500 psig, about 1.02 inches per second; and at about 4900 psig, about 1.15 inches per second. The burn rates are relatively equivalent to those of BTA in Example 4 whereby the energetic character of the acidic bi-tetrazole BTA is approximately equivalent to the energy character of the EBT fuel of the present invention. Furthermore, EBT, unlike BTA, is not disadvantaged by friction and impact sensitivity. Accordingly, more energy is provided by EBT than other safer compounds containing the bi-tetrazole moiety, such as the amine salts of tetrazoles of Examples 5 and 6. As such, remedial measures such as manufacturing a more robust inflator, or, adding energetic constituents such as metallic oxidizers to modify the burn rate, are not necessary.

Example 8

Impact Sensitivity of BHT and BHT-2NH3

BHT and the di-ammonium salt of BHT were tested for impact sensitivity as per the Bruceton test. The Drop Hammer height of BHT acid was about six inches. The Drop Hammer height of BHT-2NH3 could not be determined but was greater than thirty inches. This example illustrates the benefit of converting the bi-tetrazole acid to an amine salt, thereby reducing the impact sensitivity.

Example 9

Impact Sensitivity of BTA and BTA-NH3

BTA and the mono-ammonium salt of BTA were tested for impact sensitivity as per the Bruceton test. The Drop Hammer height of BTA acid was about five inches. The Drop Hammer height of BTA-NH3 was about twenty-six inches. This example illustrates the benefit of converting the bi-tetrazole acid to an amine salt, thereby reducing the impact sensitivity.

Example 10

Impact Sensitivity of BTE and EBT

BTE and EBT were tested for impact sensitivity as per the Bruceton test. The Drop Hammer height of BTE, resulting in detonation, was about eight inches, an acceptable impact sensitivity. The Drop Hammer height of EBT, resulting in detonation, was about ten inches, an acceptable impact sensitivity. This example illustrates the improvement of the fuels of the present invention, that is reduced sensitivity, while yet exhibiting a substantially equivalent energy of the BTA and BHT acidic bi-tetrazoles.

Example 11

Heat of Formation of BHT and BHT-2NH3

BHT and the di-ammonium salt of BHT were evaluated relative to their respective heat of formation: the heat of formation of BHT and BHT-2NH3 was 1040 and 215 cal/g, respectively. The available heat energy of the amine salt is only about twenty percent of the acid, illustrating the loss of energy when the acid is converted to a salt, and combined into a gas generating composition.

Example 12

Heat of Formation of BTA and BTA-NH3

BTA and the di-ammonium salt of BTA were evaluated relative to their respective heat of formation: the heat of formation of BTA and BTA-NH3 was 507 and 108 cal/g, respectively. The available heat energy of the amine salt is only about twenty percent of the acid, illustrating the loss of energy when the acid is converted to a salt, and combined into a gas generating composition.

Example 13

Impact Sensitivity of BTE and EBT

BTE and EBT were evaluated relative to their respective heat of formation: the heat of formation of BTE and EBT was 327 and 830 cal/g, respectively. The available heat energy of each compound in accordance with the present invention is greater than the amine salts of Examples 11 and 12. EBT is notably more energetic, and in view of its relatively lower impact sensitivity is a preferred bi-tetrazole connected by the alkyl bridge. The additional carbon in the respective bridge of each compound is oxidized to carbon dioxide which provides additional heat to the combustion gases. Note that the amine salts of tetrazoles provide additional nitrogen which essentially is converted to nitrogen without oxidation—as such, no energy is contributed to the combustion process. On the other hand, ethylene bi-tetrazole adds some additional energy in the form of the 2 double-bonded carbon atoms between the tetrazole rings, and is chemically and thermally stable with ammonium nitrate or phase stabilized ammonium nitrate even during and after heat aging.

Example 14

Thermal Stability and Gas Yield of EBT/PSAN

A sample composition of EBT and PSAN, when combined in accordance with the present invention, was heat aged per USCAR standards at about 107 C for about 400 hours and found to be thermally stable. The mass loss for a 17:83 ratio of an EBT/PSAN composition, by weight percent was 0.59 wt. %. The mass loss for a sample of EBT, when heat aged at about 107 C for about 400 hours, was 0.33 wt. %. The composition has a gas yield of 96%.

In further accordance with the present invention, a gas generator or gas generating system, and a vehicle occupant protection system incorporating the novel fuels and gas generant compositions are also included.

As shown in FIG. 1, an exemplary inflator or gas generating system 10 incorporates a dual chamber design to tailor containing a primary gas generating composition 12 formed as described herein, may be manufactured as known in the art. U.S. Pat. Nos. 6,422,601, 6,805,377, 6,659,500, 6,749,219, and 6,752,421 exemplify typical airbag inflator designs and are each incorporated herein by reference in their entirety.

Figure 2:
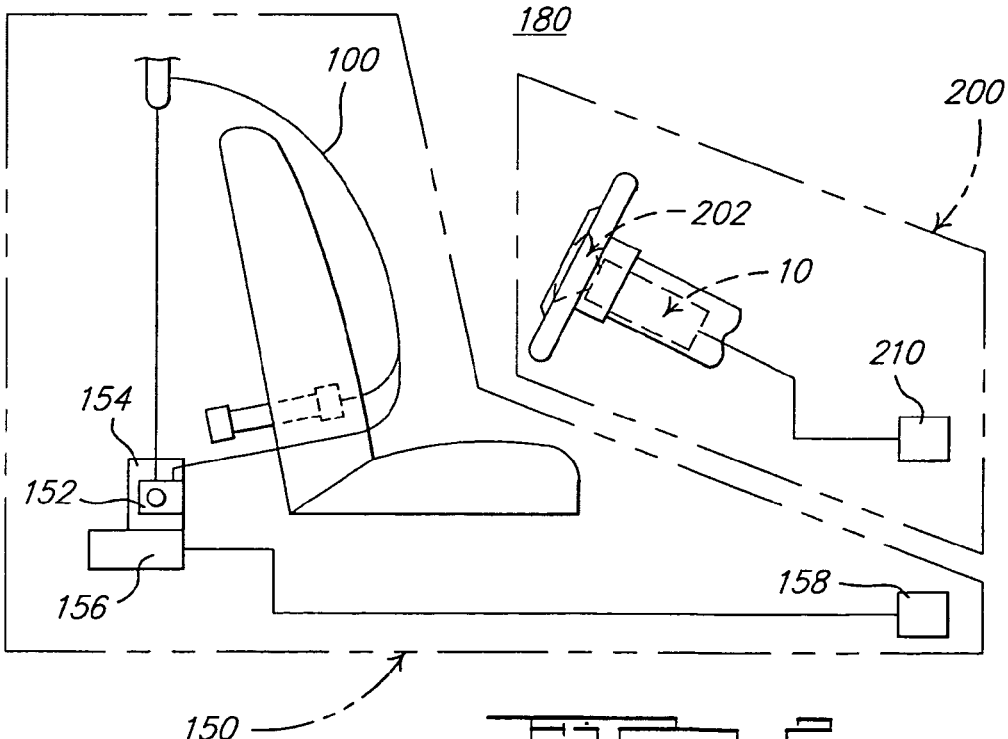
FIG. 2 is a schematic representation of an exemplary vehicle occupant restraint system containing a gas generant composition in accordance with the present invention.

Referring now to FIG. 2, the exemplary inflator or gas generating system 10 described above may also be incorporated into an airbag system 200. Airbag system 200 includes at least one airbag 202 and an inflator 10 containing a gas generant composition 12 in accordance with the present invention, coupled to airbag 202 so as to enable fluid communication with an interior of the airbag. Airbag system 200 may also include (or be in communication with) a crash event sensor 210. Crash event sensor 210 includes a known crash sensor algorithm that signals actuation of airbag system 200 via, for example, activation of airbag inflator 10 in the event of a collision.

Referring again to FIG. 2, airbag system 200 may also be incorporated into a broader, more comprehensive vehicle occupant restraint system 180 including additional elements such as a safety belt assembly 150. FIG. 2 shows a schematic diagram of one exemplary embodiment of such a restraint system. Safety belt assembly 150 includes a safety belt housing 152 and a safety belt 100 extending from housing 152. A safety belt retractor mechanism 154 (for example, a spring-loaded mechanism) may be coupled to an end portion of the belt. In addition, a safety belt pretensioner 156 containing gas generating/auto ignition composition 12 may be coupled to belt retractor mechanism 154 to actuate the retractor mechanism in the event of a collision. Typical seat belt retractor mechanisms which may be used in conjunction with the safety belt embodiments of the present invention are described in U.S. Pat. Nos. 5,743,480, 5,553,803, 5,667,161, 5,451,008, 4,558,832 and 4,597,546, incorporated herein by reference. Illustrative examples of typical pretensioners with which the safety belt embodiments of the present invention may be combined are described in U.S. Pat. Nos. 6,505,790 and 6,419,177, incorporated herein by reference.

Safety belt assembly 150 may also include (or be in communication with) a crash event sensor 158 (for example, an inertia sensor or an accelerometer) including a known crash sensor algorithm that signals actuation of belt pretensioner 156 via, for example, activation of a pyrotechnic igniter (not shown) incorporated into the pretensioner. U.S. Pat. Nos. 6,505,790 and 6,419,177, previously incorporated herein by reference, provide illustrative examples of pretensioners actuated in such a manner.

It should be appreciated that safety belt assembly 150, airbag system 200, and more broadly, vehicle occupant protection system 180 exemplify but do not limit gas generating systems contemplated in accordance with the present invention.

It should further be understood that the preceding is merely a detailed description of various embodiments of this invention and that numerous changes to the disclosed embodiments can be made in accordance with the disclosure herein without departing from the scope of the invention. The preceding description, therefore, is not meant to limit the scope of the invention. Rather, the scope of the invention is to be determined only by the appended claims and their equivalents.

What is claimed is:

1. A composition comprising:

a bi-tetrazole, wherein said bi-tetrazole is a primary tetrazole ring connected to a second tetrazole ring via an alkenyl or alkynyl bridge, and an oxidizer selected from basic metal nitrates, and, metal and nonmetal nitrates, chlorates, perchlorates, nitrites, oxides, peroxides, and mixtures thereof, said oxidizer provided at about 55-95 weight percent and said bi-tetrazole is provided at about 5-45 weight percent.

2. The composition of claim 1 wherein said bi-tetrazole contains 2 to 5 carbons.

3. The composition of claim 1 wherein said bi-tetrazole is ethylene bi-tetrazole.

4. The composition of claim 1 wherein said fuel is ethylene bi-tetrazole and said oxidizer is phase stabilized ammonium nitrate.

5. The composition of claim 1 wherein said composition is a gas generating composition.

6. A gas generating composition comprising:

a bi-tetrazole, wherein said bi-tetrazole is a primary tetrazole ring substituted with a second tetrazole ring by an alkenyl or alkynyl bridge having two to five carbons, said fuel provided at about 5-45 weight percent; and an oxidizer selected from basic metal nitrates, and, metal and nonmetal nitrates, chlorates, perchlorates, nitrites, oxides, peroxides, and mixtures thereof, said oxidizer provided at about 55-95 weight percent.

7. The gas generating composition of claim 6 wherein said bi-tetrazole is ethylene bi-tetrazole.

8. The gas generating composition of claim 6 wherein said oxidizer is phase stabilized ammonium nitrate.

9. The gas generating composition of claim 6 wherein said bi-tetrazole is ethylene bi-tetrazole.

10. The gas generating composition of claim 6 wherein said composition is about 17 wt. % ethylene bi-tetrazole and about 83 wt. % phase stabilized ammonium nitrate.

* * * * *